US007080682B2

(12) United States Patent
Ko et al.

(10) Patent No.: US 7,080,682 B2
(45) Date of Patent: Jul. 25, 2006

(54) HEAT EXCHANGER

(75) Inventors: Cheol-Soo Ko, Gunpo (KR); Se-Yoon Oh, Seoul (KR); Sai-Kee Oh, Seoul (KR); Yong-Cheol Sa, Anyang (KR); Dong-Yeon Jang, Siheung (KR)

(73) Assignee: LG Electronics Inc., Seoul (KR)

( * ) Notice: Subject to any disclaimer, the term of this patent is extended or adjusted under 35 U.S.C. 154(b) by 70 days.

(21) Appl. No.: 10/853,106

(22) Filed: May 26, 2004

(65) Prior Publication Data

US 2004/0226700 A1 Nov. 18, 2004

Related U.S. Application Data

(62) Division of application No. 10/338,000, filed on Jan. 8, 2003, now abandoned.

(30) Foreign Application Priority Data

Aug. 23, 2002 (KR) ..... 10-2002-0050216

(51) Int. Cl.
*F28D 1/02* (2006.01)

(52) U.S. Cl. ..... 165/152; 165/181

(58) Field of Classification Search ..... 165/152, 165/153, 181

See application file for complete search history.

(56) References Cited

U.S. PATENT DOCUMENTS

| | | | | |
|---|---|---|---|---|
| 4,615,384 | A | 10/1986 | Shimada et al. | |
| 5,329,988 | A | 7/1994 | Juger | |
| 5,730,214 | A * | 3/1998 | Beamer et al. | 165/152 |
| 6,401,809 | B1 * | 6/2002 | Zhang et al. | 165/152 |
| 6,932,153 | B1 * | 8/2005 | Ko et al. | 165/152 |

FOREIGN PATENT DOCUMENTS

| | | | |
|---|---|---|---|
| CN | 1153287 | A | 7/1997 |
| FR | 1521499 | | 4/1968 |
| JP | 56-3895 | A | 1/1981 |
| JP | 59-189292 | A | 10/1984 |
| JP | 59-81942 | A | 11/1984 |
| JP | 60-20094 | A | 2/1985 |
| JP | 61-235690 | A | 10/1986 |
| JP | 62-276394 | A | 12/1987 |
| KR | 100202061 | B1 | 3/1999 |

* cited by examiner

*Primary Examiner*—Ljiljana Ciric
(74) *Attorney, Agent, or Firm*—Birch, Stewart, Kolasch & Birch, LLP

(57) ABSTRACT

A heat exchanger which reduces a flow loss of air and increases a heat exchange performance by preventing condensate water from staying at surfaces of fins. To this end, the heat exchanger includes: a plurality of tubes arranged with a predetermined interval so as to pass a fluid for the heat exchange; and fins mounted among the tubes for expanding a contact area with air, wherein the fins are tilted with a predetermined angle so as to prevent condensate water from staying at the surfaces of the fins.

5 Claims, 5 Drawing Sheets

HEAT EXCHANGER

This application is a Divisional of application Ser. No. 10/338,000, filed on Jan. 8, 2003, now abandoned, and for which priority is claimed under 35 U.S.C. § 120; and this application claims priority of Application No. 50216/2002 filed in Korea on Aug. 23, 2002, under 35 U.S.C. § 119; the entire contents of all are hereby incorporated by reference.

BACKGROUND OF THE INVENTION

1. Field of the Invention

The present invention relates to a heat exchanger, and more particularly, to a heat exchanger which can smoothly discharge condensate water generated at the time of a heat exchange.

2. Description of the Background Art

Generally, a heat exchanger is a device for exchanging heat by contacting two different fluids directly or indirectly and the heat exchanger is used to a heater, a cooler, an evaporator, a condenser, and etc.

FIG. 1 is a perspective view of a heat exchanger which is mainly used in a conventional refrigerator.

The conventional heat exchanger comprises: an inlet pipe 102 for introducing a fluid for heat exchange; tubes 104 connected to the inlet pipe 102 with a predetermined interval along a longitudinal direction thereof for passing a refrigerant and performing a heat exchange; fins 106 mounted among the tubes 104 respectively for expanding a contact area with air passing through the tubes 104 so as to enhance a heat transmittance performance; and a discharge pipe 108 connected to the other side end portion of the tubes 104 for discharging a fluid which completed a heat exchange.

The fins 106, as shown in FIG. 2, have plate portions 112 attached to one side surface of the tubes 104 with a predetermined interval and having a plane shape by being curved several times. Herein, louvers 114 playing a role of a flow passage of the condensate water are protruded at the upper surfaces of the plate portions 112 with a predetermined width.

The louvers 114, as shown in FIG. 3, are formed in accordance with that the plate portions 112 are cut with a predetermined interval and protruded to an upper portions of the plate portions 112 with a predetermined width. Predetermined slits 116 are formed between the plate portions 112 and the louvers 114. Through the slits 116, the condensate water is discharged.

In the conventional heat exchanger, a fluid introduced into the inlet pipe 102 is distributed to the respective tubes 104 and collected in the discharge pipe 108 by passing the tubes 104, thereby being discharged. At this time, the fluid passing through the tubes 104 and air passing through the fins 106 installed among the tubes 104 are intercrossed, thereby performing a heat exchange.

At the time of heat exchanging of the heat exchanger, condensate water condensed from moisture contained in peripheral air attaches at the surfaces of the tubes 104 and the fins 106. The condensate water drops downwardly through the slits 116 between the plate portions 112 and the louvers 114 and is collected in a drain pan (not shown), thereby being discharged outwardly.

However, in the conventional heat exchanger, since the plate portions and the louvers are respectively formed as a flat form, the condensate water stays at the upper surfaces of the plate portions and the louvers. Therefore, air passing through the fins is prevented from flowing, thereby generating a flow loss. Also, in accordance with that a film of the condensate water becomes thick at the surfaces of the plate portions and the louvers, a heat exchange performance is degraded.

SUMMARY OF THE INVENTION

Therefore, an object of the present invention is to provide a heat exchanger which can reduce a flow loss of air and increase a heat exchange performance in which condensate water is smoothly discharged by improving a fin structure and the condensate water is prevented from staying at a surface of the fin.

To achieve these and other advantages and in accordance with the purpose of the present invention, as embodied and broadly described herein, there is provided a heat exchanger comprising: a plurality of tubes arranged with a predetermined interval so as to pass a fluid for heat exchange; and fins respectively mounted among the tubes for expanding a contact area with air, in which the fins are tilted with a predetermined angle so as to prevent condensate water from staying at the surfaces of the fins.

The fins of the heat exchanger include plate portions attached to one side surface of the tubes with a predetermined interval; and louvers protruded at the upper surfaces of the plate portions with a predetermined width, in which the louvers are formed to have a predetermined tilt angle.

The louvers of the heat exchanger are formed to have a predetermined tilt angle on the basis of their width direction.

The louvers of the heat exchanger are formed to have a predetermined tilt angle towards a downward direction along a direction which the air flows.

The fins of the heat exchanger include: plate portions attached to one side of the tubes with a predetermined interval; and louvers protruded at the upper surfaces of the plate portions with a predetermined width, in which the plate portions are formed to have a predetermined tilt angle.

The fins of the heat exchanger include: plate portions attached to one side of the tubes with a predetermined interval; and louvers protruded at the upper surfaces of the plate portions with a predetermined width, in which the plate portions and the louvers are formed to respectively have predetermined tilt angles on the basis of their width directions.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

A heat exchanger according to the preferred embodiments will be explained with reference to attached drawings.

Figure 1:
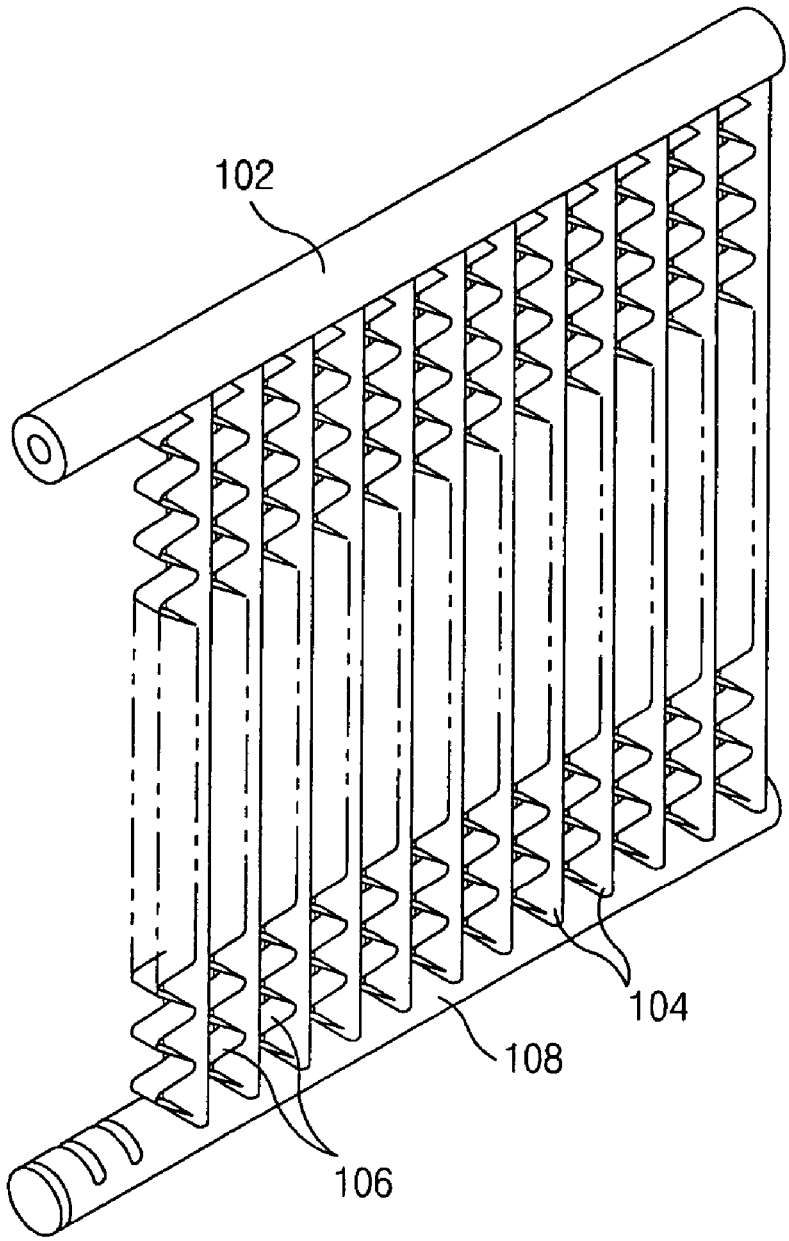
FIG.1 CONVENTIONAL ART
FIG. 1 is a perspective view of a heat exchanger in accordance with the conventional art.
Figure 2:
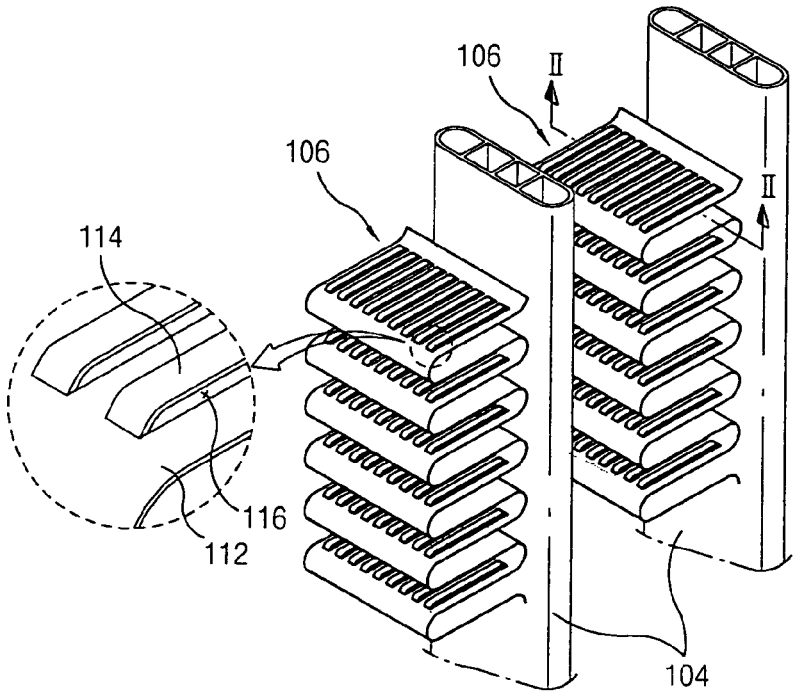
FIG.2 CONVENTIONAL ART
FIG. 2 is a partial enlargement view of the heat exchanger in accordance with the conventional art.
Figure 3:
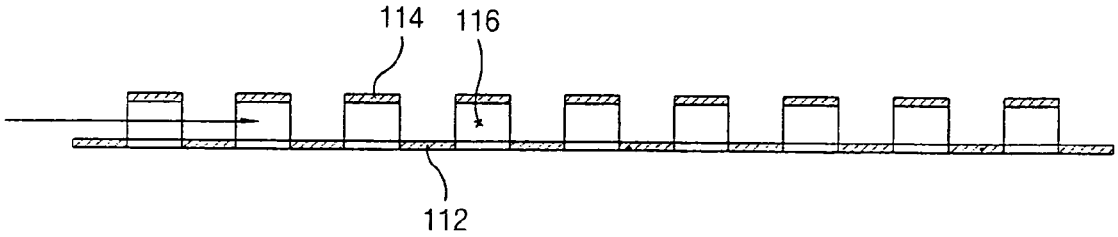
FIG.3 CONVENTIONAL ART
FIG. 3 is a sectional view taken along line II—II of FIG. 2.
Figure 4:
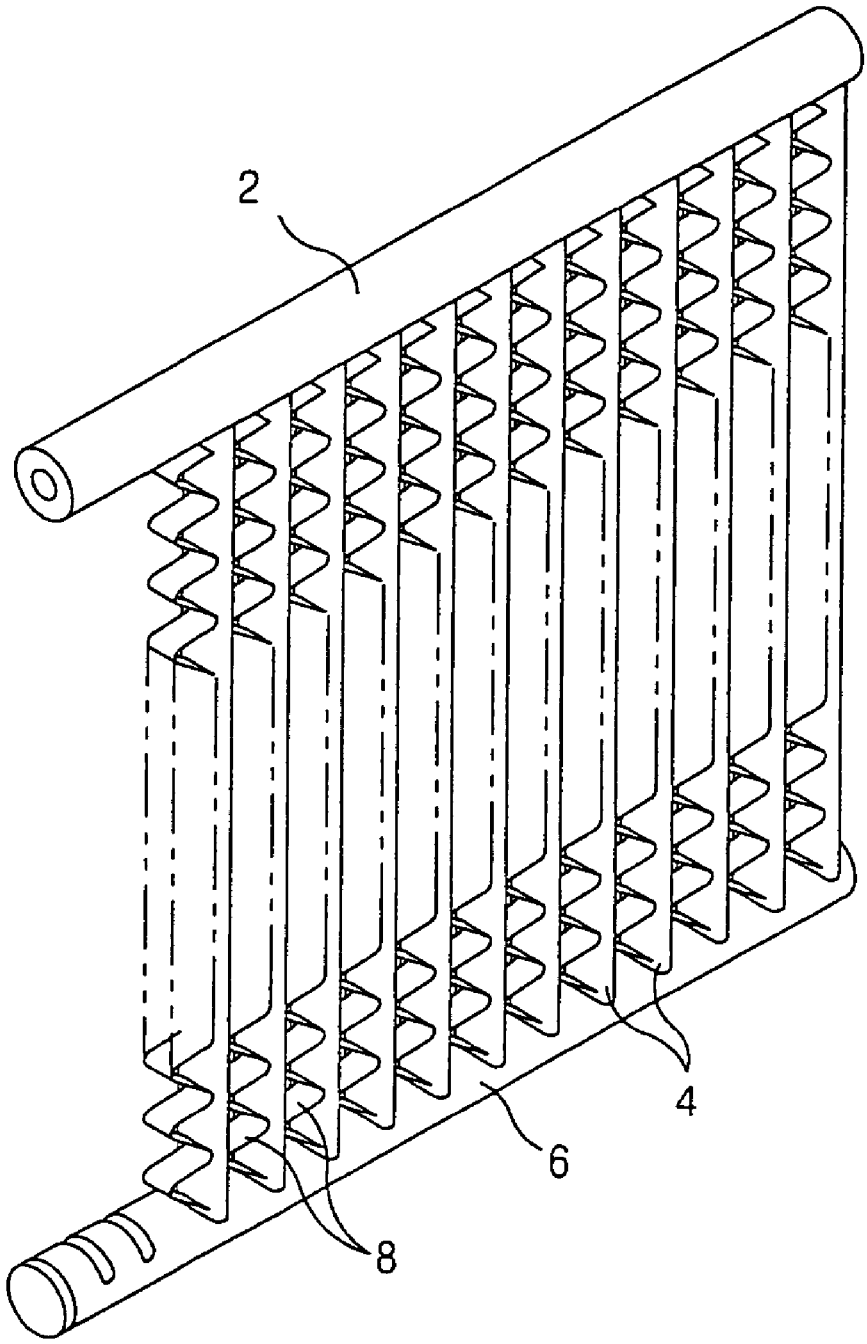
FIG. 4 is a perspective view of a heat exchanger according to the present invention.

FIG. 4 is a perspective view of the heat exchanger according to the present invention.

The heat exchanger according to the present invention comprises: an inlet pipe 2 for introducing a fluid for heat exchange; a plurality of tubes 4 connected to the inlet pipe 2 with a predetermined interval along a longitudinal direction thereof for passing the fluid introduced into the inlet pipe 2 and performing a heat exchange; a discharge pipe 6 connected to the other sied end portion of the tubes 4 for discharging the fluid which completed a heat exchange; and a plurality of fins 8 mounted among the tubes 4 respectively for expanding a contact area with air passing through the tubes 4.

The inlet pipe 2 and the discharge pipe 6 are formed as cylindrical shapes having predetermined lengths, respectively, and both end portions of the tubes 4 are respectively connected thereto with a predetermined interval towards a longitudinal direction thereof.

Figure 5:
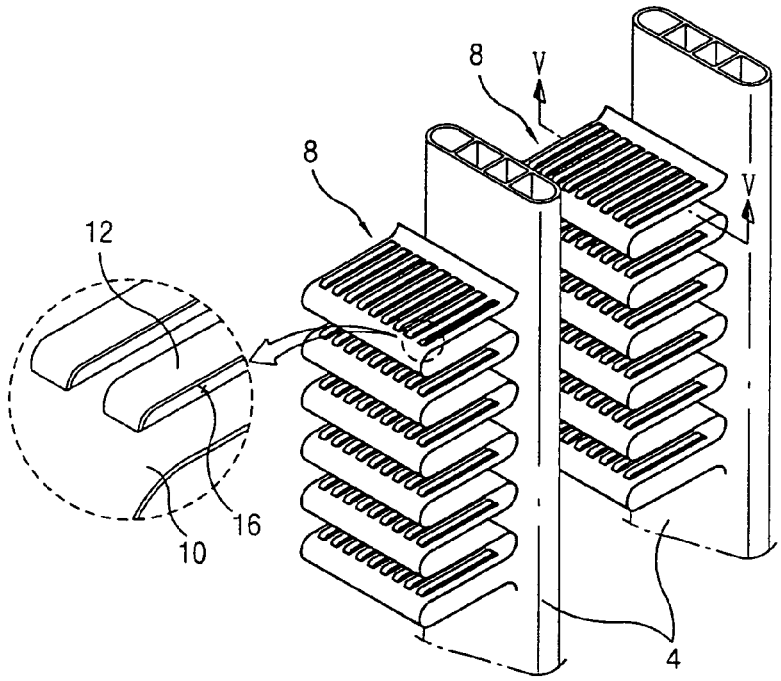
FIG. 5 is a partial enlargement view of the heat exchanger according to one preferred embodiment of the present invention.
Figure 6:
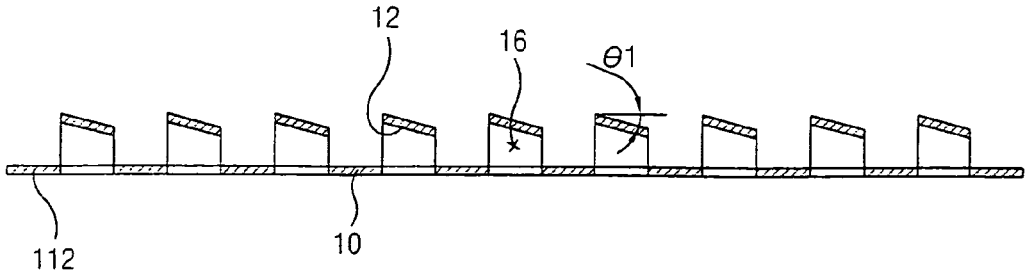
FIG. 6 is a sectional view taken along line V—V of FIG. 5 according to the one preferred embodiment of the present invention.

FIG. 5 is a partial enlargement view of the heat exchanger according to the present invention, and FIG. 6 is a sectional view taken along line V—V of FIG. 5 according to one preferred embodiment of the present invention.

The fins 8 are attached to one side surfaces of the tubes 4 with a predetermined width as a fold form and include the plate portions 10 arranged with a predetermined interval.

Herein, the louvers 12 playing a role of a flow passage by which the condensate water is discharged are protruded at the upper surfaces of the plate portions 10 with a predetermined interval. The louvers 12 are formed in accordance with that the plate portions 10 are cut with a predetermined interval and curved towards an upper direction with a predetermined width. Also, a slits 16 having a predetermined width are formed between the louvers 12 and the plate portions 10, thereby discharging the condensate water and passing air.

At this time, the louvers 12 are formed as a shape having a predetermined length perpendicularly to a flow direction of the air and having a predetermined width along a direction which the air passes. The louvers 12 are formed to have a predetermined tilt angle (Θ1) on the basis of their width direction to prevent the condensate water from staying at the surfaces of the louvers 12, in which the tilt angle (Θ1) of the louvers 12 are tilted downwardly along a direction which air is introduced.

That is, since the louvers 12 are formed to have a predetermined tilt angle, the condensate water does not stay at the surfaces of the louvers 12 and is smoothly discharged towards a gravitation direction.

Operations of the heat exchanger according to the preferred embodiment of the present invention will be explained.

If a fluid to be heat- exchanged is introduced into the inlet pipe 2, the fluid passes the tubes 4 connected to the inlet pipe 2 as a longitudinal direction with a predetermined interval and is intercrossed with external air passing through the fins 8 mounted among the tubes 4, thereby performing a heat exchange. The fluid which completed the heat exchange is collected into the discharge pipe 6 and discharged.

At the time of heat exchanging of the heat exchanger according to the present invention, the condensate water condensed from moisture contained in peripheral air stays at the surfaces of the tubes 4 and the fins 8. The condensate water moves towards a down direction by gravitation and is collected in the drain pan (not shown), thereby being discharged outwardly.

At this time, since the louvers 12 are formed to have a predetermined tilt angle towards a downward direction along a direction which the air flows, the condensate water does not stay at the surfaces the louvers 12 but drops to a downward direction by the gravitation. The condensate water is smoothly discharged through the slits 16 between the louvers 12 and the plate portions 10.

Figure 7:
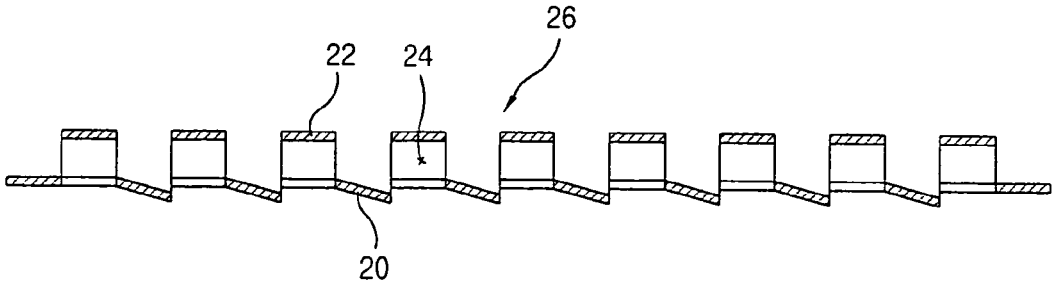
FIG. 7 is a sectional view of the fins according to the second preferred embodiment of the present invention.

FIG. 7 is a sectional view of the fins according to the second preferred embodiment of the present invention.

The heat exchanger according to the second embodiment of the present invention has the same construction with that of the first embodiment except that a structure of the fins is differently formed.

That is, the fins 26 of the heat exchanger according to the second embodiment include the plate portions 20 and the louvers 22 protruded at the upper surfaces of the plate portions 20 with a predetermined width, in which the plate portions 20 have a predetermined tilt angle on the basis of their width direction and the louvers 22 have a flat surface.

That is, the plate portions 20 are formed to have a predetermined tilt angle towards a downward direction along a direction which the air flows, so that the condensate water attached to the surfaces of the plate portions 20 does not stay at the surfaces of the plate portions 20 and drops by the gravitation, thereby being discharged towards a downward direction through the slits 24 between the plate portions 20 and the louvers 22.

Figure 8:
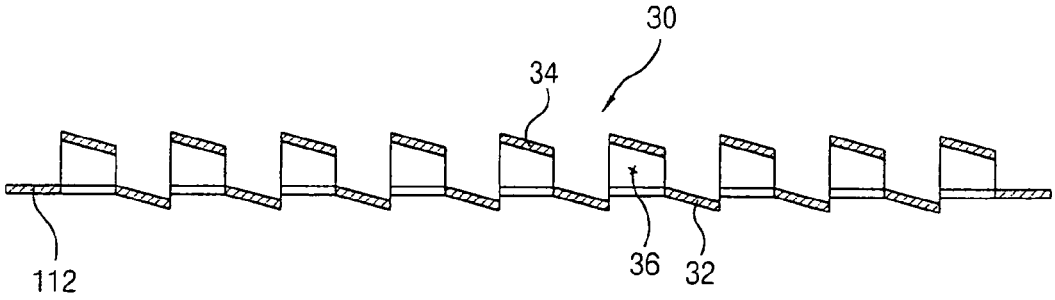
FIG. 8 is a sectional view of the fins according to the third preferred embodiment of the present invention.

FIG. 8 is a sectional view of the fins according to the third embodiment of the present invention.

The heat exchanger according to the third embodiment has the same structure with that of said embodiment except that a structure of the fins is different.

The fins 30 of the heat exchanger according to the third embodiment include the plate portions 32 and the louvers 34 protruded at the upper surfaces of the plate portions 32 with a predetermined width, in which the plate portions 32 and the louvers 34 are formed to have predetermined tilt angles on the basis of their width directions.

That is, the plate portions 32 are formed to have a predetermined tilt angle towards a downward direction along a direction which the air flows and the louvers 34 are also formed to have a predetermined tilt angle towards a downward direction along a direction which the air flows, so that the condensate water attached to the surface of the plate portions 32 does not stay at the surfaces of the plate portions 32 and drops by the gravitation and the condensate water attached to the surface of the louvers 34 does not stay at the surfaces of the louvers 34 and drops by the gravitation, thereby being discharged towards a downward direction through the slits 36 between the plate portions 32 and the louvers 34.

The heat exchanger according to the present invention has the following advantages.

First, since the plate portions and the louvers of the heat exchanger are formed to respectively have predetermined tilt angles on the basis of their width directions, the condensate water attached to the plate portions and the louvers does not stay at the surfaces thereof but is smoothly discharged towards a gravitation direction. Accordingly, air flows smoothly through the slits between the plate portions and the louvers and through a passage among the fins.

Also, since a film of the condensate water is prevented from being formed at the surfaces of the fins, a heat exchange performance is increased.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A heat exchanger comprising:

an inlet pipe for introducing a fluid for heat exchange;

a plurality of tubes connected to the inlet pipe with a predetermined interval along a longitudinal direction of the inlet pipe for passing the fluid introduced into the inlet pipe and performing heat exchange;

a discharge pipe connected to the other side end portions of the tubes for discharging the fluid which completed heat exchange; and folded fins respectively mounted at one side of the tubes for expanding a contact area with air passing through a passage among the tubes, said fins having louvers protruding from a surface of said fins and spaced a distance from said surface, and plate portions between said louvers, at least a portion of said plate portions remaining at said surface;

wherein both of the louvers and the plate portions are tilted in the same direction at a non-zero predetermined angle to said surface, said angle being large enough to prevent condensate water from staying at surfaces of the fins.

2. The heat exchanger of claim 1, wherein air flows in a direction across a width of said surface and both of the louvers and the plate portions are tilted downwardly along said direction.

3. The heat exchanger of claim 1, wherein both of the louvers and the plate portions are formed as a planar shape.

4. The heat exchanger of claim 1, wherein the surface of the folded fins in which the louvers and plate portions are formed is perpendicular to a vertical direction.

5. The heat exchanger of claim 1, wherein each of said plate portions have one edge at said surface and the remainder extending downwardly below said surface.

* * * * *